US005723418A

United States Patent [19]

Person Hei et al.

[11] Patent Number: 5,723,418

[45] Date of Patent: Mar. 3, 1998

[54] ALKYL ETHER AMINE CONVEYOR LUBRICANTS CONTAINING CORROSION INHIBITORS

[75] Inventors: Kimberly L. Person Hei, Oakdale; Michael E. Besse, Golden Valley; Bruce E. Schmidt, St. Paul; Christopher S. Sykes, New Brighton, all of Minn.

[73] Assignee: Ecolab Inc., St. Paul, Minn.

[21] Appl. No.: 655,952

[22] Filed: May 31, 1996

[51] Int. Cl.[6] ..... C10M 129/26; C10M 133/04; C10M 173/02

[52] U.S. Cl. ..... 508/511; 508/579

[58] Field of Search ..... 508/506, 562, 508/559, 511, 579

[56] References Cited

U.S. PATENT DOCUMENTS

| | | | |
|---|---|---|---|
| Re. 30,885 | 3/1982 | Rieder . | |
| 2,758,086 | 8/1956 | Stuart et al. | 252/32.5 |
| 2,779,740 | 1/1957 | Messina . | |
| 3,148,747 | 9/1964 | Batchelor . | |
| 3,170,539 | 2/1965 | Snay et al. . | |
| 3,336,225 | 8/1967 | Sayad et al. . | |
| 3,382,032 | 5/1968 | Cox | 44/320 |
| 3,576,234 | 4/1971 | Batchelor . | |
| 3,583,914 | 6/1971 | Garvin et al. . | |
| 3,645,897 | 2/1972 | Gower et al. . | |
| 3,661,784 | 5/1972 | Bellos . | |
| 3,766,068 | 10/1973 | Tesdahl et al. . | |
| 3,860,521 | 1/1975 | Aepli et al. . | |
| 4,226,325 | 10/1980 | Vandas . | |
| 4,233,176 | 11/1980 | Conner, Sr. . | |
| 4,289,636 | 9/1981 | Davis et al. . | |
| 4,342,596 | 8/1982 | Conner, Sr. . | |
| 4,348,210 | 9/1982 | Sung . | |
| 4,419,253 | 12/1983 | Kennedy et al. | 508/506 |
| 4,511,482 | 4/1985 | Horodysky . | |
| 4,521,321 | 6/1985 | Anderson . | |
| 4,552,569 | 11/1985 | Horodysky . | |
| 4,557,848 | 12/1985 | Sung et al. | 508/562 |
| 4,566,879 | 1/1986 | Horodysky . | |
| 4,581,039 | 4/1986 | Horodysky . | |
| 4,589,992 | 5/1986 | Phillips et al. . | |
| 4,604,220 | 8/1986 | Stanton . | |
| 4,613,343 | 9/1986 | Horodysky et al. . | |
| 4,626,367 | 12/1986 | Kuwamoto et al. . | |

(List continued on next page.)

FOREIGN PATENT DOCUMENTS

| | | |
|---|---|---|
| A-70188/91 | 8/1991 | Australia . |
| 0 044 458 (A1) | 1/1982 | European Pat. Off. . |
| 0 233 774 (A3) | 8/1987 | European Pat. Off. . |
| 0 310 363 (A1) | 4/1989 | European Pat. Off. . |
| 0 372 628 (A2) | 6/1990 | European Pat. Off. . |
| 0 384 282 (A1) | 8/1990 | European Pat. Off. . |
| 0 445 525 (A1) | 9/1991 | European Pat. Off. . |
| 0 260 508 (A3) | 3/1988 | Germany . |
| 60-135492 | 7/1985 | Japan . |
| 2055794 | 2/1990 | Japan . |
| WO 9417170 A | of 0000 | WIPO . |
| WO 90/10053 | 9/1990 | WIPO . |
| WO 94 12028 | 9/1994 | WIPO . |
| WO 95/14795 | 6/1995 | WIPO . |
| WO 95 26389 | 10/1995 | WIPO . |

OTHER PUBLICATIONS

"Specifications and Properties of DUOMEEN® Diamines and Diamine Salts DUOMAC® Diamine Acetate Salts", *Armak Chemical Bulletin 85–1* pp. 1–5 (1985), month unknown.

S. Block, "Disinfection, Sterilization, and Preservation," Lea & Febiger, pp. 228,248–249 (1991), month unknown.

S. Budavari, et al., "The Merck Index", Merck & Co., Inc., p. 323 (1989), month unknown.

B. Davis "Recent Developments in the Technology of Surfactants", *Critial Reports on Applied Chemistry*, vol. 30, pp. 65–73 (1990), month unknown.

G. Denton, "Chlorhexidine", Ch. 16, pp. 274–275, Date Unknown.

G. Variotin, "Inhibition and Distruction of the Microbiol. Cell", P.F. D'Arcy, pp. 636–639,675 and 685, Date Unknown.

Tomah Product, Inc. brochure, date unknown, "Ever Evolving Chemistry . . . Everlasting Quality . . . ", Tomah Products, Inc., 1012 Terra Drive, Milton, WI 55363 Date Unknown.

"Ether Amines" brochure, Tomah Products, Inc., 1012 Terra Drive, Milton, Wisconsin, Mar. 2, 1995.

"Sokalan® DCS", Technical Information, BASF, Apr. 1988.

"Abstracts of Dimer Acid Use–Patents and Journal References", Emery Industries, Inc., Technical Bulletin 412C, Sep., 1971.

*Primary Examiner*—Margaret Medley

*Attorney, Agent, or Firm*—Merchant, Gould, Smith, Edell, Welter & Schmidt, P.A.

[57] ABSTRACT

The invention is a lubricant concentrate composition, use solution, and method of use. The lubricant includes amine compounds of the formula, $$R_1—O—R_2—NH_2,$$

$$R_1—O—R_2—NH—R_3—NH_2,$$

and mixtures thereof wherein $R_1$ may be a linear $C_6$–$C_{18}$ alkyl, $R_2$ may be a linear or branched $C_1$–$C_8$ alkyl, and $R_3$ may be a linear $C_1$–$C_8$ alkyl, and a corrosion inhibitor. The lubricant composition preferably includes a polycarboxylic acid as a corrosion inhibitor. The composition may also include a hydrotrope, stabilizer, and a surfactant to provide detergency to the composition upon dilution and use. The invention also includes a lubricant use solution resulting from dilution of this concentrate.

45 Claims, No Drawings

U.S. PATENT DOCUMENTS 4,719,084 1/1988 Schmid et al. .
4,752,405 6/1988 Kyle et al. .
4,789,493 12/1988 Horodysky .
4,824,586 4/1989 Johnson et al. .
4,828,735 5/1989 Minagawa et al. .
4,828,737 5/1989 Sandberg et al. .
4,839,067 6/1989 Jansen .
4,849,119 7/1989 Horodysky .
4,895,668 1/1990 Singh et al. .
5,062,978 11/1991 Weber et al. .
5,073,280 12/1991 Rossio et al. ..... 252/49.3
5,174,914 12/1992 Gutzmann .
5,182,035 1/1993 Schmidt .
5,223,162 6/1993 Rossio ..... 252/33.2
5,282,992 2/1994 Reichgott ..... 508/559
5,441,654 8/1995 Rossio ..... 508/562
5,510,045 4/1996 Remus ..... 252/49.3

ALKYL ETHER AMINE CONVEYOR LUBRICANTS CONTAINING CORROSION INHIBITORS

FIELD OF THE INVENTION

The invention relates generally to amine-based lubricant compositions and methods of use. More specifically, the invention relates to antimicrobial conveyor lubricants containing corrosion inhibitors which are based upon compositions which include linear alkyl ether amine and/or diamine compounds.

BACKGROUND OF THE INVENTION

Beverages and other comestibles are often processed and packaged on mechanized conveyor systems. These conveyor systems are lubricated to reduce friction between the packaging and the load bearing surface of the conveyor.

Antimicrobial agents are useful for conveyor systems which may transport food substances. Spillage of beverage and other comestibles on the conveyor often results in the growth of bacteria, yeast and mold and may create a slime or soil which, in turn, hampers conveyor performance and may also detract from product purity and appearance. Antimicrobial agents are particularly useful for reducing such slime formation in conveyor systems which transport food substances.

In the past, the lubricants commonly used on the load bearing surfaces of these conveyor systems typically contained fatty acid soaps as the active lubrication ingredient, and antimicrobial agents to control microbial growth. However, the tendency of fatty acid soap lubricants to react with water hardness ions compromised the overall performance of the lubricant.

Lubricant compositions which do not contain fatty acids have been developed in an effort to avoid or eliminate the precipitation problem encountered when the lubricant is diluted with water containing hardness ions. For example, Jansen, U.S. Pat. No. 4,839,067 discloses a process for the maintenance of chain-type conveyor belts by treating the conveyor belt with a lubricant composition containing a lubricating amount of a neutralized $C_{12-18}$ primary fatty amine. However, as noted in Jansen, the primary fatty acid amines tend to form a precipitate in the presence of anions such as $SO_4^{-2}$, $PO_4^{-3}$ and $CO_3^{-2}$, commonly found as impurities in water which will plug spray nozzles and soil the surfaces of the conveyor system in much the same way as fatty acid soaps in the presence of water hardness.

Schmidt et al., U.S. Pat. No. 5,182,035 discloses aliphatic ether diamine acetates which are used in lubricant compositions in combination with alcoholic hydrotropes used to enhance physical stability.

Weber et al., U.S. Pat. No. 5,062,978 also discloses aqueous lubricant compositions based upon fatty alkyl amines which are useful in conveyor belt operations, especially in the transport of bottles.

Schapira, Published European Patent Application No. 0,533,522 A1 discloses lubricant compositions comprising branched saturated or unsaturated $C_6$ to $C_{21}$ alkyl ether amines and diamines. The lubricant compositions are useful in conveyor operations and may also comprise a surfactant, and alcohol solvent.

An additional precipitate problem occurs with the formation of a black precipitate which occurs during the production of certain foods. This black precipitate most often occurs during the production, processing and bottling of carbonated beverages such as beer. In the past, this precipitate has formed to varying degrees in given applications. The precipitate is believed to result from metal on metal wear, metal corrosion, and the interaction of certain food soils, (otherwise present in the processing environment) with the lubricant used in the application.

Hence a need still exists for an antimicrobial lubricant for use on all packaging materials and conveyor surfaces, which provides improved metal on metal lubricity with corrosion inhibition properties.

SUMMARY OF THE INVENTION

In accordance with a first aspect of the invention, there is provided a lubricant concentrate composition having an effective lubricating amount of amine compound of the formula, $$R_1—O—R_2—NH_2$$

$$R_1—O—R_2—NH—R_3—NH_2$$

and mixtures thereof wherein $R_1$ may be a linear saturated or unsaturated $C_6$–$C_{18}$, $R_2$ may be a linear or branched $C_1$–$C_8$ alkyl, and $R_3$ may be a linear or branched $C_1$–$C_8$ alkyl. The concentrate contains a corrosion inhibitor and may also contain a surfactant in an amount effective to provide detergency to the concentrate upon dilution and use, and an acid in an amount effective to solubilize the amine. Optionally, the concentrate may also comprise a hydrotrope for product stability.

The invention also provides a lubricant use solution resulting from dilution of this concentrate, with the amine compound present in a concentration ranging from about 10 ppm to 10000 ppm.

In accordance with another aspect of the invention there is provided a method of lubricating a conveyor system with a use solution of the lubricant concentrate composition of the invention.

The invention is a lubricant comprised of linear alkyl ether amines and corrosion inhibitors. The linear alkyl ether amine lubricants of the invention promote lubricity and solubility in aqueous systems in the presence of ions and beverage soil, and remain in solution over a wide pH range. The lubricants of the invention remain stable and substantially unreacted with free anions and food soil present in the system. Furthermore, the linear alkyl ether amines of the invention negate the need for alcohol type solvents to maintain physical stability of the concentrate. Compositions of the invention also provide reduced metal corrosion and improved metal lubricity. The claimed invention also provides good gliding action at low dilution rates for polyethylene terephthalate (PET), glass, and metal surfaces. Further, the lubricants of the invention also provide antimicrobial efficacy on non-food contact surfaces providing a bacterial reduction of 99.9 within five minutes.

DETAILED DESCRIPTION OF THE PREFERRED EMBODIMENT

The invention is a lubricant concentrate composition and use solution. The concentrate may be a solid or a liquid. The compositions of the invention include linear alkyl ether amine compounds which provide lubricity, antimicrobial character, as well as a reduction in the formation of various precipitates which often occur in the environment of use. Compositions of the invention also include corrosion inhibitors, detergency agents, an acid source, and optional hydrotropes, among other constituents. The invention also includes methods of using the claimed invention.

A. The Alkyl Ether Amine Compounds

The lubricant of the invention comprises an amine compound. The amine compound functions to enhance compositional lubricity, further antimicrobial character, and reduce or eliminate the formation of various precipitates resulting from the dilution of water and/or contaminants on the surface of application.

The amine compounds of the invention may comprise any number of species. Preferably, the amine compound is an alkyl ether amine compound of the formula, $$R_1—O—R_2—NH_2, \quad (1)$$

$$R_1—O—R_2—NH—R_3—NH_2, \quad (2)$$

and mixtures thereof wherein $R_1$ may be a linear saturated or unsaturated $C_6$–$C_{18}$ alkyl, $R_2$ may be a linear or branched $C_1$–$C_8$ alkyl, and $R_3$ may be a linear or branched $C_1$–$C_8$ alkyl.

More preferably, $R_1$ is a linear $C_{12}$–$C_{16}$ alkyl; $R_2$ is a $C_2$–$C_6$ linear or branched alkyl; and $R_3$ is a linear or branched $C_2$–$C_6$ alkyl.

Preferred compositions of the invention include linear alkyl ether amine compounds of formulas (1) and (2) wherein $R_1$ is $C_{12}$–$C_{16}$, $R_2$ is $C_3$ and $R_3$ is $C_3$.

When the amine compound used is an amine of formula (1) and/or (2), $R_1$ is either a linear alkyl $C_{12}$–$C_{16}$ or a mixture of linear alkyl $C_{10}$–$C_{12}$ and $C_{14}$–$C_{16}$.

Overall the linear alkyl ether amine compounds used in the composition of the invention provide lower use concentrations, upon dilution, with enhanced lubricity. The amount of the amine compound in the concentrate generally ranges from about 0.1 wt-% to 90 wt-%, preferably about 0.25 wt-% to 75 wt-%, and more preferably about 0.5 wt-% to 50 wt-%.

The amine materials are commercially available from Tomah Products Incorporated as PA-19, PA-1618, PA-1816, DA-1618, DA-18, DA-19, DA-1816, and the like.

The use dilution of the concentrate is preferably calculated to get disinfectant or sanitizing efficacy in the intended application of use. Accordingly, the active amine compound concentration in the composition of the invention ranges from about 10 ppm to 10000 ppm, preferably from about 20 ppm to 7500 ppm, and most preferably about 40 ppm to 5000 ppm.

B. Corrosion Inhibitors

The concentrate and use dilution compositions of the invention also include a corrosion inhibitor. Useful corrosion inhibitors include polycarboxylic acids such as short chain carboxylic diacids, triacids, as well as phosphate esters and combinations thereof. Useful phosphate esters include alkyl phosphate esters, monoalkyl aryl phosphate esters, dialkyl aryl phosphate esters, trialkyl aryl phosphate esters, and mixtures thereof such as Emphos PS 236 commercially available from Witco Chemical Company.

More specifically, the esterified alkyl phosphoric acids or phosphates correspond to the general formula (3):

$$R_1—O—[CH_2CH_2—O]n—PO_3X_2 \quad (3)$$

in which $R_1$ is a linear or branched saturated primary alkyl group, $C_8$ to $C_{12}$, X is hydrogen and/or an alkali metal, and n is an integer in the range from about 3 to 10.

The esterified alkyl aryl phosphoric acids or phosphates correspond to the general formula (4):

$$R_2R_3—C_6H_3—O—[—CH_2CH_2—O]n—PO_3X_2 \quad (4)$$

in which $R_2$ is linear or branched saturated primary alkyl groups, $C_8$ to $C_{10}$, $R_3$ is hydrogen, or linear or branched saturated primary alkyl groups, $C_8$ or $C_{10}$, X is hydrogen and/or an alkali metal, and n is an integer in the range from about 4 to about 10.

Other useful corrosion inhibitors include the triazoles, such as benzotriazole, tolyltriazole and mercaptobenzothiazole, and in combinations with phosphonates such as 1-hydroxyethylidene-1, 1-diphosphonic acid, and surfactants such as oleic acid diethanolamide and sodium cocoamphohydroxy propyl sulfonate, and the like.

In accordance with the invention, the preferred corrosion inhibitors are polycarboxylic acids such as dicarboxylic acids. The acids which are preferred include adipic, glutaric, succinic, and mixtures thereof. The most preferred is a mixture of adipic, glutaric and succinic acid, which is a raw material sold by BASF under the name SOKALAN® DCS.

The corrosion inhibitors concentration in the composition range from 0.05% to 25% and, preferably, from 0.1% to 20%, in the concentrate. In one preferred aspect, the concentrate comprises from about 1 wt-% to 6 wt-% of corrosion inhibitor and comprises the Sokalan® DCS diacid mixture.

C. Neutralizing Agents

Generally, a neutralizing agent may also be used to provide an effective pH between about 5 and 10 in both the concentrate and use solution.

Exemplary acids include organic and inorganic acids. Inorganic acids useful in the composition of the invention include hydrochloric acid, phosphoric acid, hydrofluoric acid, sulfuric acid, nitric acid, hydrobromic acid, and sulfamic acid, among others.

Organic acids useful in the invention include acetic acid, hydroxyacetic acid, gluconic acid, lactic acid, benzoic acid, $C_8$–$C_{20}$ saturated and unsaturated fatty acids, such as oleic acid, and mixtures thereof.

The concentration of acid should be adequate and effective to solubilize and stabilize the various constituents and the concentrate and use dilution compositions of the invention.

D. Surfactants

The lubricant compositions of the invention optionally, but preferably, may further include a surfactant. The surfactant functions as an adjuvant to increase detergency and lubricity. Compounds which may be used as surfactants in the invention include, nonionic surfactants, amphoteric surfactants, anionic surfactants, and cationic surfactants, among other compounds.

Anionic surfactants are generally those compounds containing a hydrophobic hydrocarbon moiety and a negatively charged hydrophilic moiety. Typical commercially available products provide either a carboxylate, sulfonate, sulfate or phosphate group as the negatively charged hydrophilic moiety. Particularly suitable anionic surfactants for use in the lubricant composition of the invention are the phosphate esters. Broadly, any of the commercially available anionic surfactants may be usefully employed in the lubricant composition of the invention.

Nonionic surfactants are generally hydrophobic compounds which bear essentially no charge and exhibit a hydrophilic tendency due to the presence of oxygen in the molecule. Nonionic surfactants encompass a wide variety of polymeric compounds which include specifically, but not exclusively, ethoxylated alkylphenols, ethoxylated aliphatic alcohols, ethoxylated amines, ethoxylated ether amines, carboxylic esters, carboxylic amides, and polyoxyalkylene oxide block copolymers.

Particularly suitable nonionic surfactants for use in the lubricant composition of the invention are the alkoxylated (preferably ethoxylated) alcohols having the general formula $R^{10}O((CH_2)_mO)_n$ wherein $R^{10}$ is an aliphatic group having from about 8 to about 24 carbon atoms, m is a whole number from 1 to about 5, and n is a number from 1 to about 40 which represents the average number of ethyleneoxide groups on the molecule.

Cationic surfactants are also useful in the invention and may also function as an additional antimicrobial. Typical examples include quaternary ammonium chloride surfactants such as n-alkyl ($C_{12-18}$) dimethyl benzyl ammonium chloride, n-alkyl ($C_{14-18}$) dimethyl benzyl ammonium chloride, n-tetradecyl dimethyl benzyl ammonium chloride monohydrate, n-alkyl ($C_{12-14}$) dimethyl 1-naphthylmethyl ammonium chloride.

Amphoteric surfactants, surfactants containing both an acidic and a basic hydrophilic group can be used in the invention. Amphoteric surfactants can contain the anionic or cationic group common in anionic or cationic surfactants and additionally can contain either hydroxyl or other hydrophilic groups that enhance surfactant properties. Such amphoteric surfactants include betaine surfactants, sulfobetaine surfactants, amphoteric imidazolinium derivatives and others.

In the concentrate, the surfactant concentration generally ranges from about 0.01 wt-% to 50 wt-%, and preferably from about 0.1 wt-% to 20 wt-%. More preferably, the surfactant concentration ranges from about 1 to 10 wt-% and the surfactant is a nonionic alcohol ethoxylate such as Neodol 25-7 from Shell Chemical.

E. Hydrotrope

The lubricant composition of the invention may optionally include an effective amount of a hydrotrope for viscosity control and cold temperature stability of the concentrate.

A variety of compatible hydrotropes are available for use in the lubricant composition including monofunctional and polyfunctional alcohols as well glycol and glycol ether compounds. Those which have been found most useful include alkyl alcohols such as, for example, ethanol, isopropanol, and the like. Polyfunctional organic alcohols include glycerol, hexylene glycol, polyethylene glycol, propylene glycol, sorbitol and the like.

The preferred hydrotropes are di-functional alcohols such as alkyl glycols. One compound which has found heightened efficacy in stabilization of the concentrate and its use solution is hexylene glycol. Generally, the concentration of the hydrotrope ranges from about 0.1 to 40 wt-%, and preferably about 1 to 25 wt-% in the concentrate. In one of the more preferred aspects of the invention, the hydrotrope is present in a concentration ranging from about 3 wt-% to 10 wt-% and comprises hexylene glycol.

WORKING EXAMPLES

The following Working Examples illustrate the various properties, characteristics, and embodiments of the invention. However, these are not intended to be limiting of the claimed invention:

EXAMPLE 1

Friction and Wear Testing

Lubricant concentrates for friction and wear testing were prepared as set forth in Table 1, by combining soft water with the hydrotrope and acid, heating to 120° F., and adding the remaining raw materials with mixing. Use solutions of these concentrates were made by combining 1000 parts tap water (5–6 grains hardness) with 2.5 parts concentrate to yield 0.25% solutions.

TABLE 1

Formulas Prepared for Friction and Wear Testing

| | wt-% | | | |
|---|---|---|---|---|
| Raw Material | 1A | 1B | 1C | 1D |
| C12/C14 alkyloxypropyl-1,3-diamino propane | 9.0 | 8.0 | 8.0 | |
| N-oleyl-1,3-diamino propane | | | | 4.0 |
| N-coco-1,3-diamino propane | | | | 4.0 |
| Glutaric/Adipic/Succinic Acid[1] | 4.0 | | | |
| Acetic Acid | | | 1.8 | 1.8 |
| Phosphate Ester[2] | | 18.2 | | |
| Hydrotrope | 7.0 | 10.0 | 10.0 | 10.0 |
| Nonionic Surfactant | 7.0 | 10.0 | 10.0 | 10.0 |
| Soft Water | 73.0 | 53.8 | 70.2 | 70.2 |

[1]Diacid mixture available from BASF Corporation as Sokalan DCS.
[2]Emphos PS 236 phosphate ester available from Witco Chemical.

A Falex Friction and Wear Machine (Faville-LeVally Corp., Model: Pin and V-Block) fitted with mild steel v-blocks (1137) and stainless steel pins (302) was employed to determine the fail point of lubricant use solutions. The solutions were circulated over the v-block and pin assembly at a rate of 100 ml/min. Meanwhile, pressure on the falex was set to 50 psi for 5 minutes, then increased to 200, 250, 300, etc. at 5 minute intervals until such time as grossly erratic torque readings or sudden loss of pressure indicated galling of the pin and/or v-blocks and hence failure. The pressure was re-set to the desired level at one minute intervals in the event that minor loss of pressure occurred. The torque, pressure, and wear as measured by tooth adjustments, were recorded each minute.

TABLE 2

Friction and Wear Fail Point Determination

| Formula | Amine Type | Acid Source | pH | Fail Point (psi) | Elapsed Time (min:sec) |
|---|---|---|---|---|---|
| 1A[1] | Linear Ether Diamines | Diacid Mixture | 6.8 | 330 | 20:00 |
| 1B[1] | Linear Ether Diamines | Phosphate Ester | 7.3 | 200 | 6:45 |
| 1C | Linear Ether Diamines | Acetic | 7.6 | 190 | 5:00 |
| 1D | Alkyl Diamines | Acetic | 7.6 | 200 | 5:30 |

[1]Formulas represent the teaching of the current invention.

Neutralization of the linear ether amines with a combination of diacids results in a reduction in friction and wear between mild steel and stainless steel. Both commercial and experimental lubricants utilizing acetic acid neutralization fail shortly after the five minute equilibration at 50 psi.

EXAMPLE 2

Corrosion Inhibition

Lubricant concentrates were prepared as set forth in Table 3 by combining soft water with the specified acid and hydrotrope, warming to 120° F., and adding the remaining raw materials with mixing.

TABLE 3

Formulas Prepared for Mild Steel Corrosion Testing

| Raw Material | wt-% 2A | 2B | 2C | 2D | 2E |
|---|---|---|---|---|---|
| Tetradecyloxypropyl-1,3-diamino propane | 6.0 | 6.0 | 6.0 | | |
| $C_{12}/C_{15}$ alkyloxypropyl-1,3-diamino propane | | | | 6.0 | 6.0 |
| Glutaric/Adipic/Succinic Acid[1] | 4.0 | | | | |
| Acetic Acid | | 2.2 | 1.1 | | |
| Glycolic Acid | | | | 4.0 | 4.0 |
| Phosphate Ester[2] | | | 9.1 | | |
| Hydrotrope | 3.0 | 3.0 | 3.0 | 5.0 | 5.0 |
| Nonionic Surfactant | 10.0 | 10.0 | 10.0 | 10.0 | 10.0 |
| Corrosion Additive[3] | | | | 5.0 | |
| Soft Water | 77.0 | 78.8 | 70.8 | 70.0 | 75.0 |

[1]Diacid mixture available from BASF Corporation as Solkalan DCS.
[2]Phosphate ester Emphos PS 236 available from Witco.
[3]Corrosion additive referenced below.

To test mild steel corrosion inhibition for lubricant concentrates containing various neutralizing agents, 0.25% use solutions were prepared with 1000 parts tap water containing 5–6 grains hardness, and the use solution pH was adjusted to 9 with dilute KOH. Pre-cleaned 1×3 inch cold rolled steel (#1018) panels were immersed in the use solution such that the use solution covered half of the coupon. Corrosion of the panel and use solution clarity were assessed visually after 24 hours, and rated according to the description listed below. All testing was completed in duplicate. The samples were evaluated on the basis of the following scale.

| Rank | Solution Appearance | Panel Corrosion |
|---|---|---|
| 1 | Solution unchanged | No visible signs of corrosion |
| 2 | Solution slightly discolored | Very slight corrosion, 1–5% of panel surface area showing corrosion. |
| 3 | Solution discolored | Moderate corrosion, 6–10% of panel surface area showing corrosion. |
| 4 | Solution is dark amber | Heavy corrosion, 11–90% of panel surface area showing corrosion. |

TABLE 4

Mild Steel Corrosion Testing Results for Formulas 2A, 2B, and 2C (0.25% Solutions Adjusted to pH 9, Ranked after 24 Hours)

| Formula | Constituent | Corrosion Rating With 2 Readings: Solution Clarity | Panel Appearance |
|---|---|---|---|
| 2A | Glutaric/Adipic/Succinic | 2,2 | 2,1 |
| 2B | Acetic | 3,3 | 3,2 |
| 2C | Phosphate Ester/Acetic | —,— | 2,3 |

To test mild steel corrosion inhibition for lubricant concentrates containing various corrosion inhibitors, 0.5% use solutions were prepared from Formulas 2D and 2E. For this evaluation the solutions were prepared by combining 5 parts concentrate with 1000 parts tap water containing 5–6 grains hardness, and the solution pH adjusted to 8 with dilute KOH. Pre-cleaned 1×3 cold rolled steel (#1018) panels were immersed in the use solution such that the use solution covered half of the coupon. Corrosion of the panel and use solution clarity were assessed visually after 48 hours, and rated. All testing was completed in duplicate.

TABLE 5

Mild Steel Corrosion Testing Results for Formulas 2D and 2E (0.50% Solutions Adjusted to pH 8, Ranked after 48 Hours)

| Formula | Corrosion Additive | Corrosion Rating with 2 Readings: Solution Clarity | Panel Appearance |
|---|---|---|---|
| 2D | Adipic Acid | 1,1 | 2,2 |
| 2D | D-isoascorbic Acid | 2,2 | 1,2 |
| 2D | Lactic Acid | 3,3 | 1,1 |
| 2D | Malic Acid | 2,2 | 1,2 |
| 2D | Oleic acid diethanolamide[1] | 3,3 | 1,1 |
| 2D | Sodium cocoamphophydroxy propyl sulfonate[2] | 3,3 | 1,1 |
| 2E | none | 3,3 | 2,2 |

[1]Alkamide WRS-166 sold by Rhone Poulenc
[2]Miranol CS sold by Rhone Poulenc.

Various corrosion inhibitors and especially the diacids provide corrosion protection against mild steel in the linear alkyl ether amine formulations. Further, it is evident that the acidic species can be incorporated for the dual role of corrosion inhibitor and amine neutralizing agent, with a benefit to production cost and efficiency.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A lubricant concentrate composition comprising:

a. an effective lubricating amount of one or more amine compounds each of said amine compounds having a formula selected from the group consisting of, $$R_1—O—R_2—NH_2,$$

$$R_1—O—R_2—NH—R_3—NH_2,$$

and mixtures thereof wherein $R_1$ is a linear saturated or unsaturated $C_6$–$C_{18}$ alkyl, $R_2$ is a linear or branched $C_1$–$C_8$ alkylene, and $R_3$ is a linear or branched $C_1$–$C_8$ alkylene;

b. an anticorrosive effective amount of a corrosion inhibitor, said corrosion inhibitor comprising a dicarboxylic acid, a tricarboxylic acid or mixture thereof; and c. a detersive amount of surfactant effective to provide detergency to the composition, said surfactant selected from the group consisting of an anionic surfactant, a nonionic surfactant, a cationic surfactant, an amphoteric surfactant, and mixtures thereof wherein said concentrate has a pH ranging from about 5 to 10 and can be diluted to produce a lubricant having a pH greater than 7.

2. The concentrate of claim 1, wherein said amine compound is present in a concentration of about from 0.1 wt-% to 90 wt-%.

3. The concentrate of claim 1, wherein said amine compound is a monoamine compound and $R_1$ is a linear $C_{12}$–$C_{16}$ alkyl group, and $R_2$ is a $C_2$–$C_6$ alkylene group.

4. The concentrate of claim 1, wherein more than one amine compound is present in said concentrate, at least one of said amine compounds is a monoamine compound, $R_1$ is selected from the group consisting of a $C_{10}$–$C_{12}$alkyl group, a $C_{14}$–$C_{16}$ alkyl group, and mixtures thereof; and $R_2$ is a $C_2$–$C_6$ alkylene group.

5. The concentrate of claim 1, wherein said amine compound is a diamine compound, $R_1$ is a $C_{12}$–$C_{16}$ alkyl group, $R_2$ is a $C_2$–$C_6$ alkylene group, and $R_3$ is a $C_2$–$C_6$ alkylene group.

6. The concentrate of claim 1, wherein more than one amine compound is present in said concentrate, at lease one of said amine compounds is a diamine compound, $R_1$ is selected from the group consisting of a $C_{10}$–$C_{12}$alkyl group, a $C_{14}$–$C_{16}$ alkyl group, and mixtures thereof; $R_2$ is a $C_2$–$C_6$ alkylene group and $R_3$ is a $C_2$–$C_6$ alkyl group.

7. The concentrate of claim 1, additionally comprises a hydrotrope.

8. The concentrate of claim 7, wherein said hydrotrope is selected from the group consisting of glycols, alcohols, glycol ethers, and mixtures thereof.

9. The concentrate of claim 7, wherein said hydrotrope comprises hexylene glycol, present in a concentration of from about 0.1 wt-% to 40 wt-%.

10. The concentrate of claim 1, wherein said corrosion inhibitor comprises a dicarboxylic acid present in a concentration of from about 0.05 wt-% to 25 wt-%.

11. The concentrate of claim 10, wherein said dicarboxylic acid is selected from the group consisting of glutaric acid, adipic acid, succinic acid and mixtures thereof.

12. The concentrate of claim 1, wherein said surfactant comprises a nonionic surfactant present in a concentration of from about 0.01 wt-% to 50 wt-%.

13. The concentrate of claim 12, wherein said nonionic surfactant has from about 1 to 40 moles of ethoxylation.

14. The concentrate of claim 1, wherein said concentrate is a solid.

15. The concentrate of claim 1, wherein said concentrate is a liquid.

16. The concentrate of claim 1, additionally comprising a neutralizing agent, wherein said neutralizing agent comprises an acid, said acid selected from the group consisting of an organic acid, an inorganic acid, and mixtures thereof.

17. The concentrate of claim 1, wherein said concentrate has a sanitizing level of antimicrobial efficacy.

18. An aqueous lubricant comprising a major portion of an aqueous diluent, from about 10 ppm to 10000 ppm of at least one amine compound, having a formula selected from the group consisting of $$R_1—O—R_2—NH_2,$$

$$R_1—O—R_2—NH—R_3—NH_2,$$

and mixtures thereof wherein $R_1$ is a linear saturated or unsaturated $C_6$–$C_{18}$ alkyl, $R_2$ is a linear or branched $C_1$–$C_8$ alkylene, and $R_3$ is a linear or branched $C_1$–$C_8$ alkylene; an anticorrosive effective amount of a corrosion inhibitor, said corrosion inhibitor comprising a dicarboxylic acid, a tricarboxylic acid or mixture thereof; a detersive amount of surfactant effective to provide detergency upon use, wherein said surfactant is selected from the group consisting of an anionic surfactant, a nonionic surfactant, a cationic surfactant, an amphoteric surfactant, and mixtures thereof, wherein said lubricant has a pH of from about 7 to 10.

19. The lubricant of claim 18, wherein said amine compound is present in a concentration of about 40 ppm to 5000 ppm.

20. The lubricant of claim 18, wherein said amine compound is a monoamine compound, $R_1$ is a linear $C_{12}$–$C_{16}$ alkyl group, and $R_2$ is a $C_2$–$C_6$ alkylene group.

21. The lubricant of claim 18, wherein more than one amine compound is present in said lubricant, at least one of said amine compounds is a monoamine compound, $R_1$ is a $C_{12}$–$C_{16}$ alkyl group and $R_2$ is a $C_2$–$C_6$ alkylene group.

22. The lubricant of claim 18, wherein said amine compound is a diamine compound, $R_1$ is a $C_{12}$–$C_{16}$ alkyl group, $R_2$ is a $C_2$–$C_6$ alkylene group, and $R_3$ is a $C_2$–$C_6$ alkylene group.

23. The lubricant of claim 18, wherein more than one amine compound is present in said lubricant, at least one of said amine compounds is a diamine compound, $R_1$ is selected from the group consisting of a $C_{10}$–$C_{12}$ alkyl group, a $C_{14}$–$C_{16}$ alkyl group, and mixtures thereof; $R_2$ is a $C_2$–$C_6$ alkylene group; and $R_3$ is a $C_2$–$C_6$ alkylene group.

24. The lubricant of claim 18, additionally comprises a hydrotrope.

25. The lubricant of claim 24, wherein said hydrotrope is selected from the group consisting of glycols, alcohols, glycol ethers, and mixtures thereof.

26. The lubricant of claim 24, wherein said hydrotrope comprises hexylene glycol, present in a concentration of from about 0.001 wt-% to 1 wt-%.

27. The lubricant of claim 18, wherein said corrosion inhibitor comprises a dicarboxylic acid present in a concentration of from about 1 ppm to 10000 ppm.

28. The composition of claim 24, wherein said dicarboxylic acid is selected from the group consisting of glutaric acid, adipic acid, succinic acid and mixtures thereof.

29. The lubricant of claim 18, wherein said surfactant comprises a nonionic surfactant present in a concentration of from about 0.0005 wt-% to 1 wt-%.

30. The lubricant of claim 29, wherein said nonionic surfactant has from about 1 to 40 moles of ethoxylation.

31. The lubricant of claim 18, additionally comprising a neutralizing agent.

32. The lubricant of claim 18, wherein said concentrate has a sanitizing level of antimicrobial efficacy.

33. A method of lubricating a conveyor system using a diluted lubricant concentrate composition comprising an effective lubricating amount of one or more amine compounds, each of said amine compounds having a formula selected from the group consisting of, $$R_1—O—R_2—NH_2, \quad (1)$$

$$R_1—O—R_2—NH—R_3—NH_2, \quad (2)$$

and mixtures thereof wherein $R_1$ is a linear saturated or unsaturated $C_6$–$C_{18}$ alkyl, $R_2$ is a linear or branched $C_1$–$C_8$ alkylene, and $R_3$ is a linear or branched $C_1$–$C_8$ alkylene; an anticorrosive effective amount of a corrosion inhibitor, said corrosion inhibitor comprising a dicarboxylic acid, a tricarboxylic acid or mixture thereof; a detersive amount of surfactant effective to provide detergency upon dilution and use said surfactant selected from the group consisting of an anionic surfactant, a cationic surfactant, a nonionic surfactant, an amphoteric surfactant, and mixtures thereof; and wherein the said composition has a pH of from about 7 to 10, said method comprising the steps of:

a. formulating the lubricant concentrate composition to have from about 0.1 wt-% to 90 wt-% of said amine compound;

b. diluting said lubricant concentrate composition with a major portion of an aqueous diluent to form a diluted lubricant concentrate composition; and c. applying said diluted lubricant concentrate composition to the intended surface of use.

34. The method of claim 33, wherein said amine compound is a monoamine compound, $R_1$ is a linear $C_{12}$–$C_{16}$ alkyl group, and $R_2$ is a $C_2$–$C_6$ alkylene group.

35. The method of claim 33, wherein more than one amine compound is present in said lubricant, and least one of said amine compound is a monoamine compound, $R_1$ is selected from the group consisting of a $C_{10}$–$C_{12}$alkyl group, a $C_{14}$–$C_{16}$ alkyl group, and mixtures thereof; and $R_2$ is a $C_2$–$C_6$ alkylene group.

36. The method of claim 33, wherein said amine compound is a diamine compound, $R_1$ is a $C_{12}$–$C_{16}$ alkyl group, $R_2$ is a $C_2$–$C_6$ alkylene group, and $R_3$ is a $C_2$–$C_6$ alkylene group.

37. The method of claim 33, wherein more than one amine compound is present in said lubricant, at least one of said amine compound is a diamine compound, $R_1$ is selected from the group consisting of a $C_{10}$–$C_{12}$ alkyl group, a $C_{14}$–$C_{16}$ alkyl group, and mixtures thereof; $R_2$ is a $C_2$–$C_6$ alkylene group, and $R_3$ is a $C_2$–$C_6$ alkylene group.

38. The method of claim 33, wherein said use solution is formulated to additionally comprise a hydrotrope.

39. The method of claim 38, wherein said hydrotrope is selected from the group consisting of glycols, alcohols, glycol ethers, and mixtures thereof.

40. The method of claim 38, wherein said hydrotrope comprises hexylene glycol, present in a concentration of from about 0.1 wt-% to 40 wt-%.

41. The method of claim 33, wherein said corrosion inhibitor comprises a dicarboxylic acid present in a concentration of from about 0.05 wt-% to 25 wt-%.

42. The method of claim 41, wherein said dicarboxylic acids are selected from the group consisting of glutaric acid, adipic acid, succinic acid and mixtures thereof.

43. The method of claim 33, wherein said surfactant comprises a nonionic surfactant present in a concentration of from about 0.01 wt-% to 50 wt-%.

44. The method of claim 33, wherein said lubricant provides a sanitizing level of antimicrobial efficacy to the intended surface of use.

45. The method of claim 33, wherein said lubricant use solution is compatible with polyethylene terephthalate.

* * * * *